US006996869B2

(12) United States Patent
Lancette

(10) Patent No.: US 6,996,869 B2
(45) Date of Patent: Feb. 14, 2006

(54) DISPENSING CARTRIDGE AND METHOD OF DISPENSING A PRODUCT FROM A DISPENSING CARTRIDGE

(75) Inventor: Christopher J. Lancette, Oakdale, MN (US)

(73) Assignee: Ecolab, Inc., St. Paul, MN (US)

( * ) Notice: Subject to any disclaimer, the term of this patent is extended or adjusted under 35 U.S.C. 154(b) by 508 days.

(21) Appl. No.: 10/304,191

(22) Filed: Nov. 25, 2002

(65) Prior Publication Data

US 2004/0098810 A1 May 27, 2004

(51) Int. Cl.
*D06F 38/02* (2006.01)

(52) U.S. Cl. ..... 8/158; 68/17 R; 222/542

(58) Field of Classification Search ..... 68/17 R, 68/207; 206/0.5, 216; 8/159, 158; 222/196, 222/216, 323
See application file for complete search history.

(56) References Cited

U.S. PATENT DOCUMENTS

| | | | | | |
|---|---|---|---|---|---|
| 1,941,125 | A | * | 12/1933 | Barsky | 206/0.5 |
| 2,315,890 | A | * | 4/1943 | Bader | 206/0.5 |
| 2,333,791 | A | | 11/1943 | Hutchison, Jr. | |
| 2,857,940 | A | * | 10/1958 | Lane | 141/360 |
| 2,956,709 | A | * | 10/1960 | Morris et al. | 222/129 |
| 3,044,667 | A | * | 7/1962 | Lucas | 222/454 |
| 3,108,722 | A | * | 10/1963 | Torongo, Jr. et al. | 222/463 |
| 3,285,042 | A | * | 11/1966 | Holleman | 68/207 |
| 3,399,806 | A | * | 9/1968 | Lucas | 222/545 |
| 3,412,254 | A | | 11/1968 | Meyer-Döering et al. | |
| 3,760,166 | A | | 9/1973 | Adams et al. | |
| 4,046,996 | A | | 9/1977 | Williams et al. | |
| 4,211,517 | A | | 7/1980 | Schmid | |
| 4,396,828 | A | | 8/1983 | Dino et al. | |
| 4,573,606 | A | | 3/1986 | Lewis et al. | |
| 4,597,091 | A | | 6/1986 | Blake | |
| 4,676,399 | A | | 6/1987 | Burckhardt | |
| 4,711,370 | A | | 12/1987 | Goudy, Jr. et al. | |
| 4,756,321 | A | | 7/1988 | Livingston et al. | |
| 4,835,804 | A | * | 6/1989 | Arnau-Munoz et al. | 8/158 |
| 4,875,600 | A | * | 10/1989 | D'Hoogue et al. | 222/52 |
| 4,915,267 | A | * | 4/1990 | Buecheler et al. | 222/463 |
| 4,942,973 | A | * | 7/1990 | Bowie | 220/201 |
| 4,980,292 | A | | 12/1990 | Elbert et al. | |
| 5,014,877 | A | | 5/1991 | Roos | |
| 5,033,643 | A | * | 7/1991 | Schumacher | 222/52 |
| 5,064,094 | A | | 11/1991 | Roos et al. | |
| 5,147,615 | A | | 9/1992 | Bird et al. | |
| 5,176,275 | A | * | 1/1993 | Bowie | 220/201 |
| 5,213,236 | A | * | 5/1993 | Brown et al. | 222/212 |
| 5,341,660 | A | * | 8/1994 | Berveglieri | 68/17 R |

(Continued)

FOREIGN PATENT DOCUMENTS

DE 39 06 030 * 8/1990

(Continued)

OTHER PUBLICATIONS

European Patent Office 249,440 Dec. 1987.*

(Continued)

*Primary Examiner*—Frankie L. Stinson
(74) *Attorney, Agent, or Firm*—Merchant & Gould

(57) ABSTRACT

A dispensing cartridge for holding a product adapted to be inserted into a machine configured to utilize the product. A container has a bottom and at least one side wall. The bottom of the container has an opening configured to cooperate with the machine. A removable cover closes the opening in the container and prevents contact with the product before the dispensing cartridge is inserted into the machine.

9 Claims, 6 Drawing Sheets

U.S. PATENT DOCUMENTS

| | | | | | |
|---|---|---|---|---|---|
| 5,388,298 | A | * | 2/1995 | Rutter et al. | 8/158 |
| 5,500,050 | A | | 3/1996 | Chan et al. | |
| 5,638,417 | A | | 6/1997 | Boyer et al. | |
| 5,671,262 | A | | 9/1997 | Boyer et al. | |
| 5,768,918 | A | * | 6/1998 | McKibben | 68/17 R |
| 5,887,753 | A | * | 3/1999 | Poolman | 222/1 |
| 5,924,151 | A | * | 7/1999 | Connan | 8/158 |
| 5,996,845 | A | * | 12/1999 | Chan | 222/107 |
| 6,006,901 | A | * | 12/1999 | Pereira Da Silva | 206/77.1 |
| 6,179,167 | B1 | * | 1/2001 | Boot et al. | 222/181.3 |
| 6,523,371 | B1 | * | 2/2003 | Sherratt et al. | 68/17 R |
| 6,547,097 | B1 | | 4/2003 | Cavallaro et al. | |
| 6,784,190 | B1 | * | 8/2004 | Askew et al. | 514/314 |
| 6,874,190 | B1 | * | 4/2005 | Deflander et al. | 8/158 |
| 2003/0182732 | A1 | * | 10/2003 | Davenet et al. | 8/158 |

FOREIGN PATENT DOCUMENTS

| | | | |
|---|---|---|---|
| DE | 39 19 688 | * | 12/1990 |
| GB | 2157717 | * | 10/1985 |
| GB | 2255985 | * | 11/1992 |
| JP | 63-214290 | * | 9/1988 |
| WO | WO 98/26704 | | 6/1998 |
| WO | WO 03/059143 A1 | | 7/2003 |

OTHER PUBLICATIONS

European Patent Office 253,419 Jun. 1987.*
European Office 479,711 Apr. 1992.*

* cited by examiner

DISPENSING CARTRIDGE AND METHOD OF DISPENSING A PRODUCT FROM A DISPENSING CARTRIDGE

TECHNICAL FIELD

This invention relates to dispensing cartridges and, more particularly to dispensing cartridges in which a user does not come into contact with the dispensed product prior to insertion of the dispensing cartridge into a receiving machine, and method therefore.

BACKGROUND

In industrial environments, it is commonly desirable to be able to insert a product, usable in a machine, into that machine without the user or operator of the machine coming into direct contact with the product. This is particularly true when the product is caustic or corrosive, or when it would otherwise be detrimental for the user or operator to come into direct contact with product.

This is particularly true in industrial laundry or washing environments where it is common for detergents and other wash aids, such as rinse aids, to be replenished in washing equipment.

Many detergents products are distributed in solid form and are dissolved in use in the machine into which the solid detergent product is utilized. Such dissolvable solid products, of which detergent is just one example, are commonly distributed in containers.

A thermoformed blister pack or a package with a lid could be used to distribute dissolvable solid detergents. This would typically require the user to remove the back or lid from the package and drop the solid detergent block into the machine utilizing the detergent. Unfortunately, this technique would expose the user of the machine to direct contact with the solid detergent block which is not desirable.

One solid dissolvable detergent block has been distributed in a shrink wrapped plastic film. Small pin holes in the film allow the evacuation of otherwise trapped air as the film shrinks to conform to the shaped of the detergent block as the detergent block is packaged. Unfortunately, these same pin holes allow moisture from the atmosphere to enter the package. The addition of moisture to a detergent block package causes the detergent block package to swell around each of the pinholes resulting in an unsightly product.

Plastic, blow molded bottles have also been used as dispensers for this type of material but such plastic, blow molded bottles also suffer from many of the disadvantages of the other packages discussed.

SUMMARY OF THE INVENTION

The present invention provides a dispensing cartridge for a product usable in a machine, particularly a dissolvable solid product, which can not easily contact the user during insertion, yet is readily usable by the machine. Also, the dispensing cartridge is economic to construct and is easy to handle by the user.

In one embodiment, the present invention provides a dispensing cartridge for holding a product adapted to be inserted into a machine configured to utilize the product. A container has a bottom and at least one side wall. The bottom of the container has an opening configured to cooperate with the machine. A removable cover closes the opening in the container and prevents contact with the product before the dispensing cartridge is inserted into the machine.

In one embodiment, the present invention provides a dispensing cartridge for holding a product adapted to be inserted into a machine configured to utilize the product. A container has a bottom and at least one side wall. The bottom of the container has an opening configured to cooperate with the machine. A removable cover closes the opening in the container and prevents contact with the product before the dispensing cartridge is inserted into the machine.

In a preferred embodiment, the removable cover is formed within the bottom of the container by perforations in the bottom of the container.

In a preferred embodiment, the removable cover is placed over the opening.

In another embodiment, the present invention provides a dispensing cartridge for holding a product adapted to be inserted into a machine configured to utilize the product. A container has a bottom and at least one side wall. The bottom of the container has an opening configured to cooperate with the machine. A removable label covers the opening in the container and prevents contact with the product before the dispensing cartridge is inserted into the machine.

In a preferred embodiment, the removable label is adhesive backed.

In another embodiment, the present invention provides a dispensing cartridge for holding a dissolvable solid product adapted to be inserted into a machine configured to utilize the dissolvable solid product by dissolving the dissolvable solid product from the dispensing cartridge. A container has a bottom, a top and at least one side wall. The bottom of the container has an opening configured to cooperate with the receptacle of the machine when the dispensing cartridge is inserted into the machine. The bottom of the container is formed from at least two angled side walls forming an acute angle at the bottom of the container. The container has a handle for aiding carrying of the dispensing cartridge before the dispensing cartridge is inserted into the machine. A removable, adhesive backed label covers the opening in the bottom of container, hermetically sealing the container, and prevents contact with the dissolvable solid product before the dispensing cartridge is inserted into the machine.

In another embodiment, the present invention provides a dispensing cartridge for holding a solid detergent product adapted to be inserted into a machine configured to utilize the solid detergent product by dissolving the solid detergent product from the dispensing cartridge. A container has a bottom, a top and at least one side wall. The bottom of the container has an opening configured to cooperate with the receptacle of the machine when the dispensing cartridge is inserted into the machine. The bottom of the container is formed from at least two angled side walls forming an acute angle at the bottom of the container. The container has a handle for aiding carrying of the dispensing cartridge before the dispensing cartridge is inserted into the machine. A removable, adhesive backed label covers the opening in the bottom of container, hermetically sealing the container, and prevents contact with the solid detergent product before the dispensing cartridge is inserted into the machine.

In a preferred embodiment, the container is thermoformed.

In a preferred embodiment, the container is a clamshell.

In a preferred embodiment, the handle is formed into the top of the container.

In another embodiment, the present invention provides a method of dispensing a dissolvable solid product into a machine. The dissolvable solid product is held in a dispensing cartridge. The dispensing cartridge is a container having a bottom and at least one side wall, the bottom of the container having an opening configured to cooperate with the machine, and a removable label covering the opening in the bottom of container preventing contact with the dissolvable solid product. The removable label is removed from the opening in the bottom of the container. The dispensing cartridge is inserted into the machine. The dissolvable solid product is dissolved from the dispensing cartridge.

In a preferred embodiment, the product is a detergent.

In a preferred embodiment, the product is a sanitizer product.

In a preferred embodiment, the product is a caustic product.

In a preferred embodiment, the product is a corrosive product.

DETAILED DESCRIPTION

Figure 1:
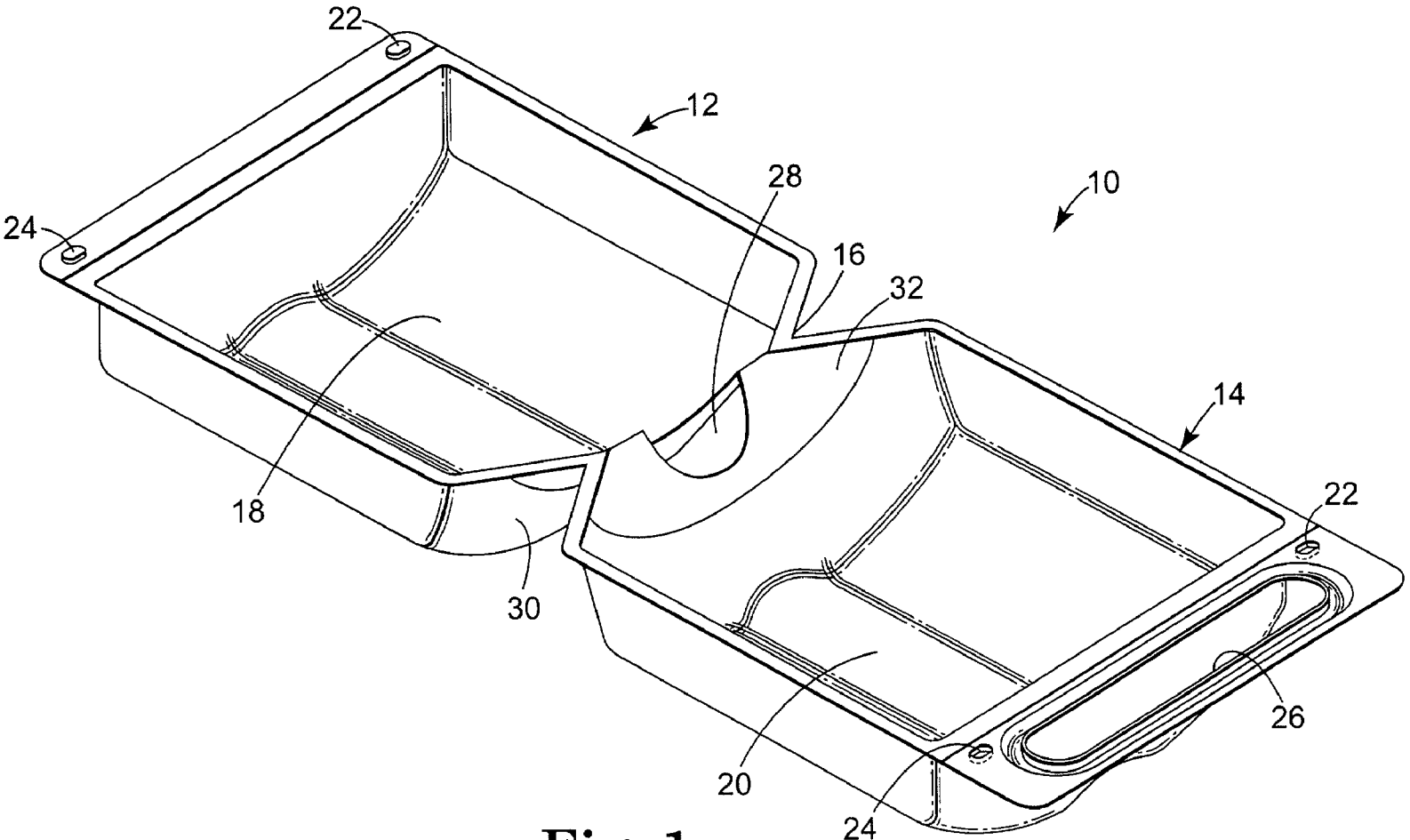
FIG. 1 is an isometric view of an embodiment of a dispensing cartridge according to the present invention with the cartridge open.
Figure 2:
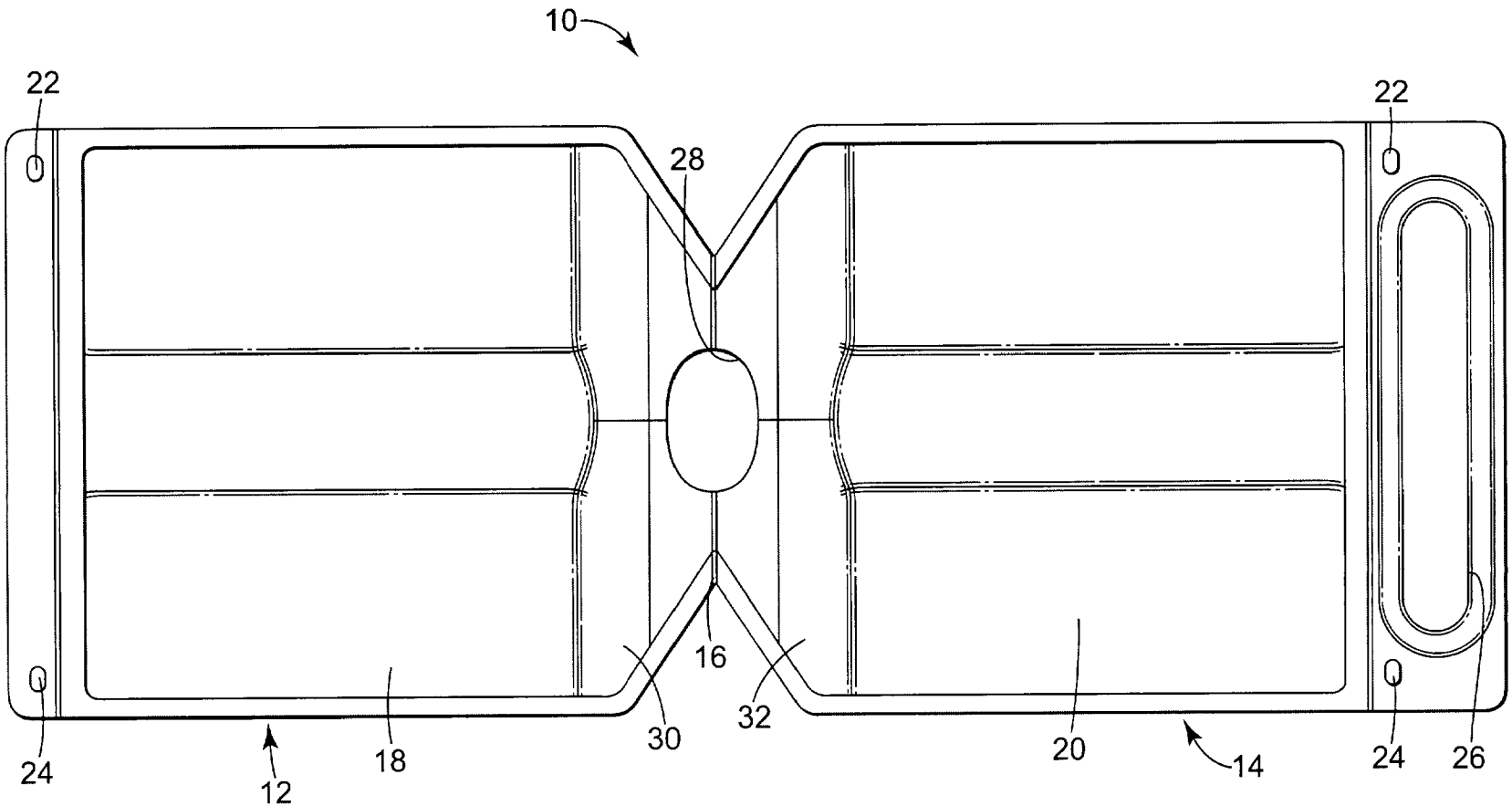
FIG. 2 is a top view of the dispensing cartridge of FIG. 1.

FIGS. 1 and 2 show an embodiment of dispensing cartridge 10 of the present invention open and without holding any product. Dispensing cartridge 10 can be thermoformed from a single piece of polyvinylchloride (PVC), polyethylene teraphalate (PET) and, preferably, high density polyethylene (HDPE). It is roughly divided into a first half 12 and a second half 14 along hinge line 16. First half 12 is formed with a first bubble 18 and second half 14 is formed with a second bubble 20. Dispensing cartridge 10 is designed to be folded along hinge line 16 using location guides 22, 24 as an aid and be sealed around the periphery of dispensing cartridge 10 with the exception of hinge line 16. First bubble 18 and second bubble 20 form a space, when dispensing cartridge 10 is closed, for holding a product to be dispensed, preferably a dissolvable solid product, such as a detergent block or a sanitizer block. A portion of both first half 12 and second half 14 near hinge line 16 is formed with angled sidewalls 30 and 32, respectively, forming an acute angle at hinge line 16. In this embodiment, first half 12 and second half 14 are about 6.625 inches (16.8 centimeters) by 5.75 inches (14.6 centimeters) and 2.139 inches (5.4 centimeters) deep.

Handle 26 is formed into one side of second half 14 opposite from hinge line 16. In this embodiment, handle 26 extends about 1.75 inches (4.45 centimeters) beyond second bubble 20 in second half 14 and extends along the long dimension of second half 14. Handle 26 allows dispensing cartridge 10 to be easily carried and to be easily inserted into a machine (not shown) into which the product is to be dispensed.

An opening 28 is cut into angled sidewalls 30 and 32 at and on either side of hinge line 16. Opening 28 is small enough to prevent the product to be dispensed from falling from dispensing cartridge 10 but large enough to allow the product to be dispensed from dispensing cartridge 10 when dispensing cartridge 10 is inserted into a receiving machine. In this embodiment, opening 28 is an oval having a longer diameter of approximately 1.75 inches and a shorter diameter of approximately 1 inch.

In this embodiment, dispensing cartridge 10 is transparent allowing a user to visually determine the amount of the product to be dispensed remaining in dispensing cartridge 10.

Figure 3:
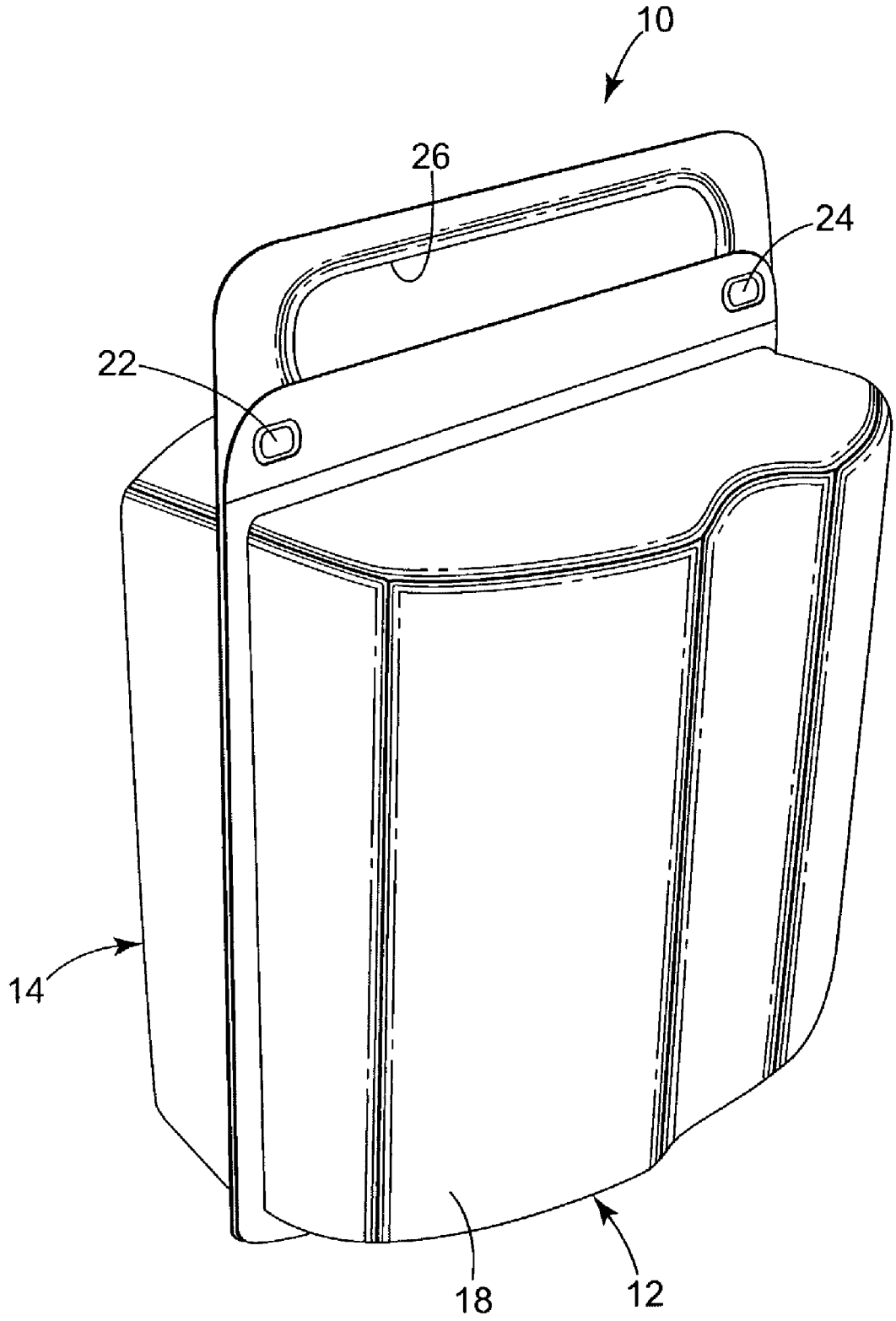
FIG. 3 is an isometric view of an embodiment of a dispensing cartridge according to the present invention with the cartridge closed holding a detergent block.
Figure 4:
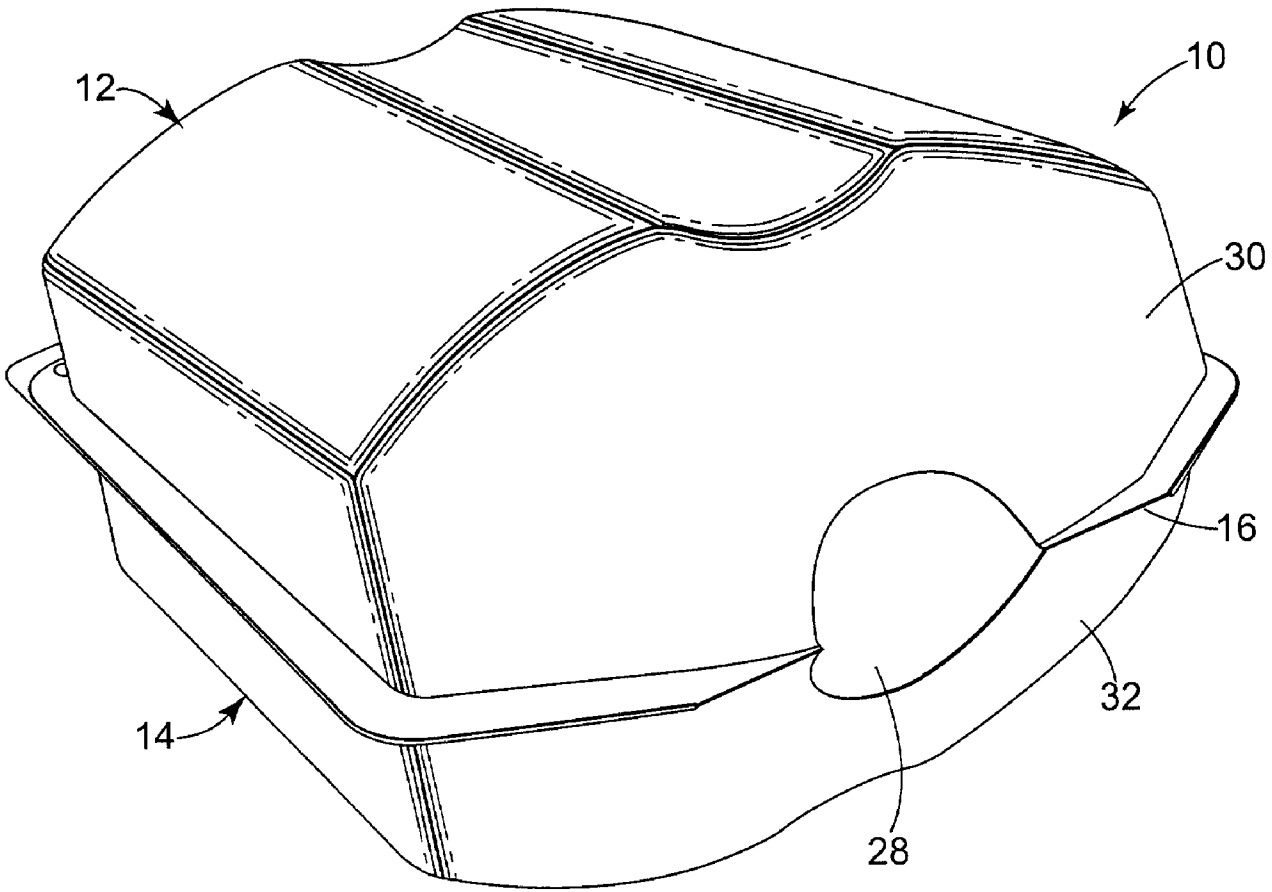
FIG. 4 is a view of the dispensing cartridge of FIG. 3 closed holding a detergent block showing an opening through which the detergent block may be dissolved.

FIGS. 3 and 4 show an embodiment of dispensing cartridge 10 in a closed position holding solid product 34 to be dispensed. In this condition, dispensing cartridge 10 has had opening 28 opened by the user and dispensing cartridge 10 is ready to be inserted into the machine into which solid product 34 is to be dispensed. These figures illustrate the ease with which dispensing cartridge 10 may be carried and inserted into the machine into which solid product 34 is to be dispensed. In operation, once inserted, liquid, preferably water, from the machine is allowed to circulate in the proximity of opening 28. Solid product 34, such as a detergent block, being dissolvable by such liquid, is gradually dissolved out of dispensing cartridge 10 and advantageously utilized by the machine, such as a laundry machine.

Figure 5:
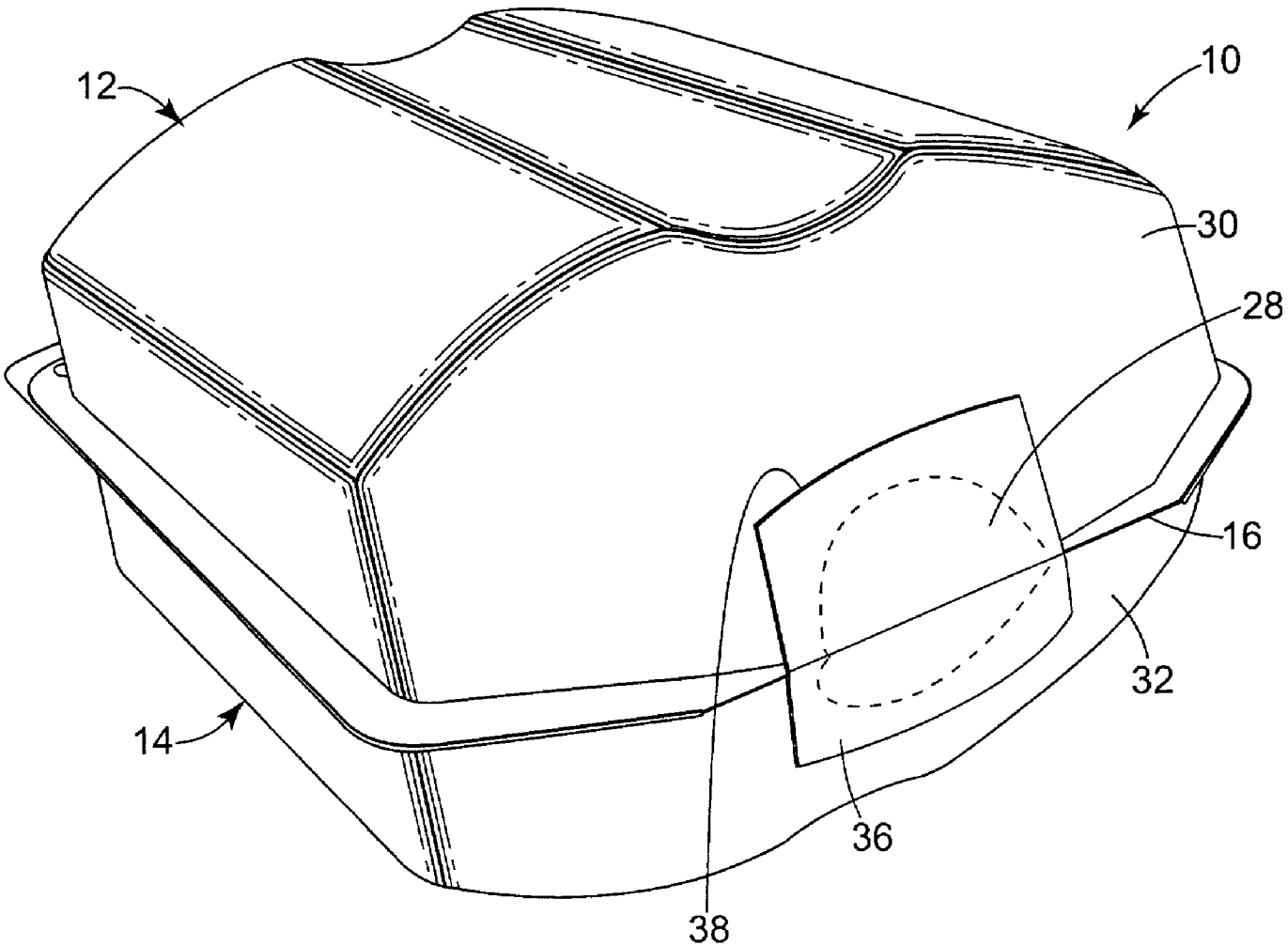
FIG. 5 is a view of the dispensing cartridge of FIG. 3 and FIG. 4 showing the opening through which the detergent may be dissolved covered with a label.

FIG. 5 shows an embodiment of dispensing cartridge 10 having label 36 secured over opening 28. Label 36 is secured in place over opening 28 with adhesive 38. It is preferred that label 36 be adhesive backed. In this embodiment, solid product 34 is distributed to the end user with label 36 in place. With label 36 in place, a user can not come into contact with solid product 34. If solid product 34 were a caustic or a corrosive product, a user would be spared direct contact with such product.

A user would remove label 36 from dispensing cartridge 10 prior to inserting dispensing cartridge 10 into the machine into which solid product 34 is to be dispensed. Even though label 36 has been removed, the relatively small surface area of dispensing cartridge 10 through which solid product 34 is exposed and the ease of manipulating dispensing cartridge 10 with handle 26 makes it easy for a user to avoid any direct contact with solid product 34.

Figure 6:
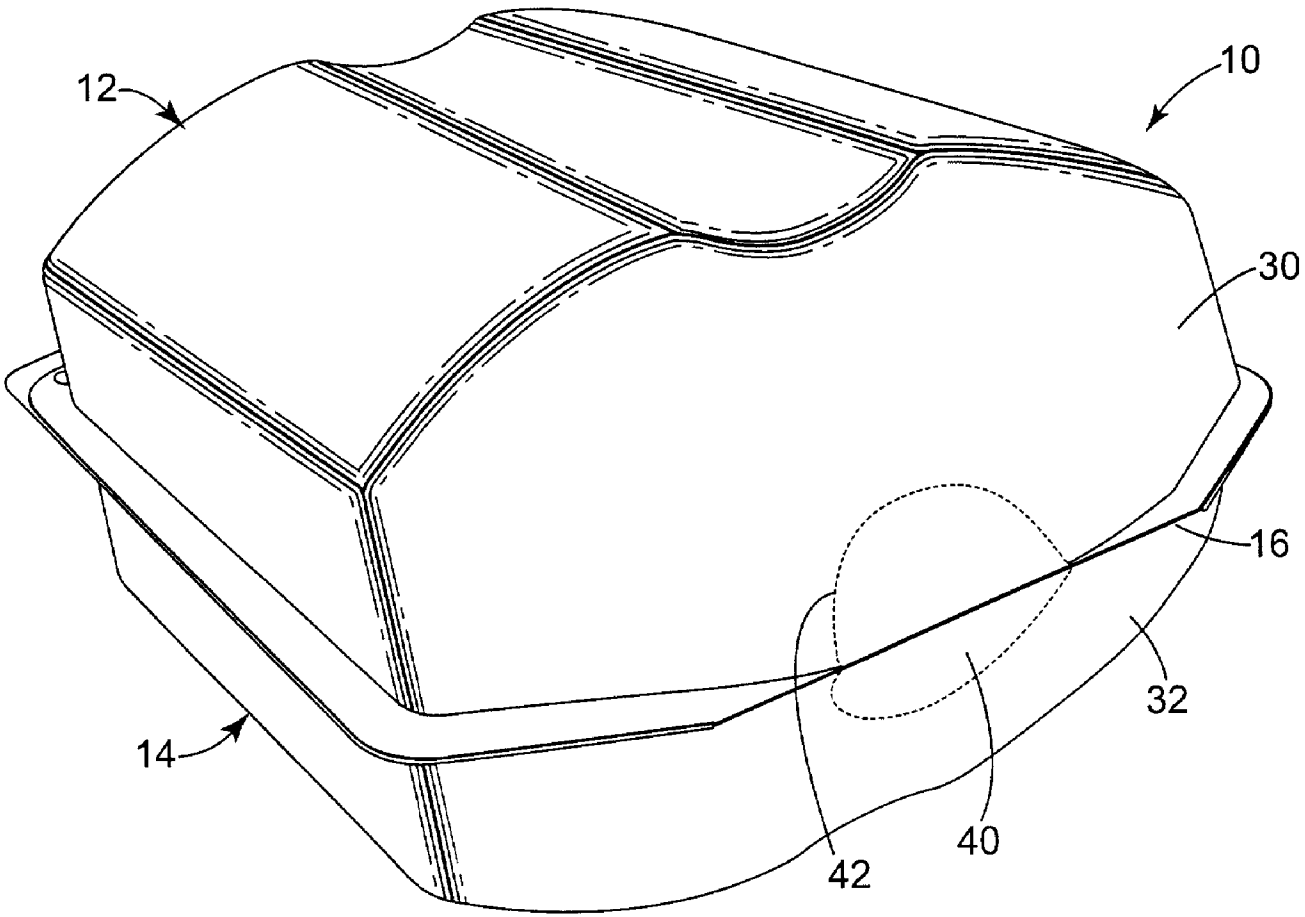
FIG. 6 is an alternative embodiment of a dispensing cartridge according to the present invention with an opening created from perforations.

FIG. 6 shows an alternative embodiment of dispensing cartridge 10 in which a covering for opening 28 is formed with the material used to formed first half 12 and second half 14. In this embodiment, instead of directly forming or cutting an opening into angled sidewalls 30 and 32, a potential opening 40 is created by perforations 42. Distributed with potential opening 40 still covering solid product 34, a user may easily tear potential opening 40 into opening 28 by removing the material of angle sidewalls 30 and 32 by tearing at perforations 42.

Various modifications and alterations of this invention will be apparent to those skilled in the art without departing from the scope and spirit of this invention. It should be understood that this invention is not limited to the illustrative embodiments set forth above.

What is claimed is:

1. A dispensing cartridge for holding a dissolvable solid product and adapted to be inserted into a machine configured to utilize said dissolvable solid product by dissolving said dissolvable solid product from said dispensing cartridge; a container having a bottom, a top and at least one side wall, said bottom of said container having an opening configured to cooperate with said receptacle of said machine when said dispensing cartridge is inserted into said machine; said bottom of said container being formed from at least two angled side walls forming an acute angle at said bottom of said container; said container having a handle for aiding carrying of said dispensing cartridge before said dispensing cartridge is inserted into said machine; a removable, adhesive backed label covering said opening in said bottom of container, hermetically sealing said container and preventing contact with said dissolvable solid product before said dispensing cartridge is inserted into said machine.

2. A dispensing cartridge as in claim 1 wherein said handle is formed into said top of said container.

3. A dispensing cartridge as in claim 1 wherein said container is thermoformed.

4. A dispensing cartridge as in claim 3 wherein said container is a clamshell.

5. A dispensing cartridge for holding a solid detergent product and adapted to be inserted into a machine configured to utilize said solid detergent product by dissolving said solid detergent product from said dispensing cartridge; a container having a bottom, a top and at least one side wall, said bottom of said container having an opening configured to cooperate with said receptacle of said machine when said dispensing cartridge is inserted into said machine; said bottom of said container being formed from at least two angled side walls forming an acute angle at said bottom of said container; said container having a handle for aiding carrying of said dispensing cartridge before said dispensing cartridge is inserted into said machine; a removable, adhesive backed label covering said opening in said bottom of container, hermetically sealing said container and preventing contact with said solid detergent product before said dispensing cartridge is inserted into said machine.

6. A dispensing cartridge as in claim 5 wherein said handle is formed into said top of said container.

7. A dispensing cartridge as in claim 5 wherein said container is thermoformed.

8. A dispensing cartridge as in claim 7 wherein said container is a clamshell.

9. A method of dispensing a dissolvable solid product into a machine, comprising the steps of: holding said dissolvable solid product in a dispensing cartridge, said dispensing cartridge comprising: a container having a bottom and at least one side wall, said bottom of said container having an opening configured to cooperate with said machine, and a removable label covering said opening in said bottom of container preventing contact with said dissolvable solid product; removing said removable label from said opening in said bottom of said container; inserting said dispensing cartridge into said machine; and dissolving said dissolvable solid product from said dispensing cartridge.

* * * * *